US005522143A

United States Patent [19]

Schliemann et al.

[11] Patent Number: 5,522,143

[45] Date of Patent: Jun. 4, 1996

[54] TENSIONING ARRANGEMENT FOR A SAW CHAIN OF A MOTOR-DRIVEN CHAIN SAW

[75] Inventors: Harald Schliemann; Werner Geyer, both of Waiblingen; Helmut Zimmermann, Kernen i.R.; Rudolf Krebs, Backnang; Hans Nickel, Cottenweiler, all of Germany

[73] Assignee: Andreas Stihl, Waiblingen, Germany

[21] Appl. No.: 338,874

[22] Filed: Nov. 14, 1994

[30] Foreign Application Priority Data

Nov. 12, 1993 [DE] Germany ..... 43 38 617.2

[51] Int. Cl.[6] ..... B27B 17/14

[52] U.S. Cl. ..... 30/386; 30/383

[58] Field of Search ..... 30/383, 386, 380; 83/813, 581.1; 198/8.3; 474/136

[56] References Cited

U.S. PATENT DOCUMENTS 3,639,995 1/1972 Newman .
4,129,943 12/1978 Bricker ..... 30/386

FOREIGN PATENT DOCUMENTS 1106264 8/1981 Canada .
0043405 1/1982 European Pat. Off. .
2692832 12/1993 France .
199714 11/1938 Switzerland .

*Primary Examiner*—Douglas D. Watts
*Attorney, Agent, or Firm*—Walter Ottesen

[57] ABSTRACT

The invention is directed to a tensioning arrangement for saw chains of motor-driven chain saws which include a device for longitudinally displacing the guide bar. The clamped guide bar is released so that the adjusting arrangement can be actuated for the longitudinal displacement of the guide bar. By rotating a disc having a spiral slot, a slide piece, which is coupled to the guide bar, is displaced in the longitudinal direction. Assembly is simplified and handling facilitated when the tension in the saw chain is adjusted. This is achieved by making the slide piece on the spiral disc so that it is not released therefrom but instead is held so as to be rotationally and longitudinally displaceable. The slide piece is fixedly connected to the guide bar by using appropriate attachment devices.

23 Claims, 8 Drawing Sheets

Fig. 10
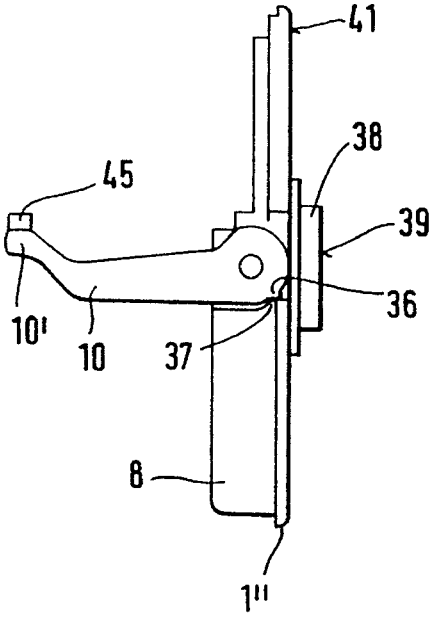
Fig. 11
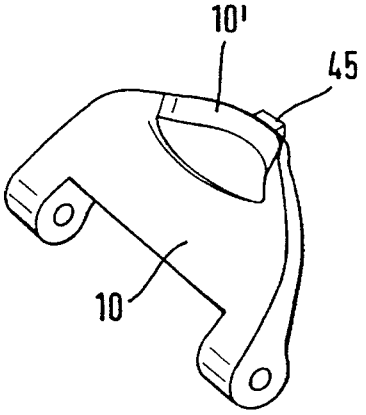
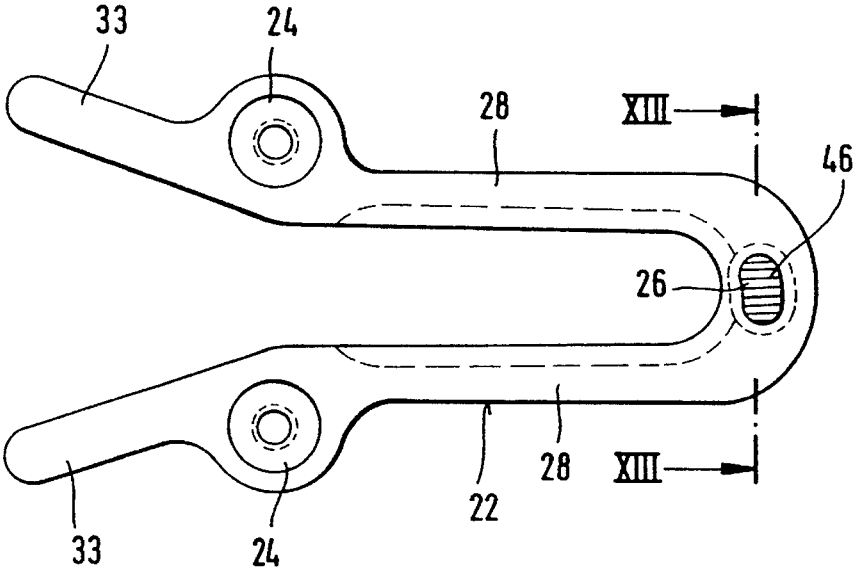
Fig. 12
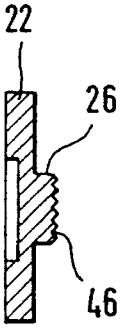
Fig. 13

TENSIONING ARRANGEMENT FOR A SAW CHAIN OF A MOTOR-DRIVEN CHAIN SAW

FIELD OF THE INVENTION

The invention relates to a tensioning arrangement for a saw chain of a motor-driven chain saw. The saw chain runs on a guide bar of the chain saw.

BACKGROUND OF THE INVENTION

U.S. patent application Ser. No. 08/296,153, filed Aug. 29, 1994, discloses a tensioning arrangement for a saw chain of a motor-driven chain saw. The saw chain runs over a guide bar of the chain saw. The guide bar is clamped at one end thereof between a housing accommodating the drive motor and a clamping element. When the clamping element is loosened, the guide bar can be displaced in the longitudinal direction so that the desired chain tension is obtained. This longitudinal movement of the guide bar is generated in that a lug of a slide piece engages a curve-shaped guide slot of a disc. The slide piece is connected to the guide bar with a form-tight interlocked connection.

The known arrangement is simple in its assembly and no tool of any kind is required in order to adjust the required chain tension.

SUMMARY OF THE INVENTION

It is an object of the invention to provide a tensioning arrangement of the kind referred to above which is further simplified with respect to assembly and which is characterized by less maintenance.

The arrangement of the invention is for tensioning the saw chain of a motor-driven chain saw having a motor housing and a guide bar for guiding the saw chain. The guide bar defines a longitudinal axis having two flat sides, one of the flat sides facing toward the housing and the other one of the flat sides facing away from the housing. The arrangement includes: the guide bar having an elongated opening formed therein so as to extend in the direction of the axis; a stud bolt fixedly attached to the housing and extending transversely to the guide bar and through the elongated opening; a clamping member mounted on the stud bolt which can be tightened to clamp the guide bar on the housing and which can be released to permit the guide bar to be moved along the axis; a slide piece fixedly attached to the guide bar and having a lug projecting from the slide piece in a direction transverse to the longitudinal axis; a rotatable disc rotatably mounted on the stud bolt; holding means for inseparably holding the slide piece on the rotatable disc so as to permit the rotatable disc to rotate relative to the slide piece and so as to permit the slide piece to move in the direction of the axis relative to the rotatable disc; the rotatable disc having an approximately spiral guide slot formed therein for receiving the lug so that a rotational movement of the rotatable disc is translated via the slide piece into a linear movement of the guide bar thereby adjusting the tension in the chain saw; and, the spiral slot being formed in the disc so as to extend spirally over a rotational angle of at least 270°.

The essential advantages of the tensioning arrangement of the invention are seen in that the spiral disc, the slide piece and the guide bar are assembled to a unit which can be manipulated as a single part. This simplifies assembly during manufacture as well as disassembly and reassembly for repair and maintenance work.

According to a feature of the invention, a hollow rivet is provided in a central opening in a spiral disc. This hollow rivet has a collar arranged at a spacing to the spiral disc plane and the slide piece is guided in this spacing. The slide piece is attached to the spiral disc so that it cannot be separated therefrom. The slide piece has only slight play when viewed in the axial direction of the disc and, furthermore, the lug of the slide piece engages into the spiral slot (guide slot).

It is desirable that a position, when selected, at which the guide bar or the chain tension is adjusted, be maintained. This adjustment should be maintained during operation of the chain saw and an unwanted displacement of the slide piece with respect to the spiral disc should not take place because of influences caused by operation such as vibrations. In order to ensure the foregoing, it is advantageous that an annular surface, which surrounds the central opening of the spiral disc, and the surface of the slide piece are made rough. This surface of the slide piece faces toward the spiral disc and defines the displacement path. For these surfaces, a knurling of ±0.05 mm is seen as advantageous. The spiral disc is preferably made of steel and the spiral slot formed therein is produced by stamping or deep drawing.

The spiral slot of the spiral disc advantageously has an angle of rotation of approximately 790° in order that the most sensitive adjustment is obtained and so that the amount of force required for making the adjustment can be held as low as possible. It is desirable that the force acting in the longitudinal direction of the guide bar generates the same torque at each location of the spiral which the slot defines. To achieve this, it is advantageous that the spiral slot is configured as a logarithmic spiral which satisfies this condition.

The spiral disc is disposed directly in the vicinity of the sprocket wheel. It is desirable that this spiral disc is not freely accessible which is purposeful for preventing accidents. For this reason, it is advantageous that the spiral disc is provided with a spur gear on its periphery which meshes with the teeth of a positioning wheel. The teeth of the spur gear are cropped so that mechanical contact of the chain and gear teeth of the spiral disc is avoided. The angle of cropping is preferably approximately 30°. It is advantageous that the spur gear include approximately 47 teeth in order to facilitate a precise adjustment in small steps.

The slide piece is configured to have an essentially U shape. This slide piece is, however, not only hooked into openings of the guide bar in a form-tight interlocked manner, but threaded bores are provided close to the free ends of the legs of the slide piece so that a connection to the guide bar with a threaded fastener is possible.

An especially suitable configuration of this connection is that the threaded bores are arranged in bushings which can be formed by deep drawing on the parallel legs of the slide piece. The number of the required individual pieces is reduced to a minimum because the slide piece also contains the thread for receiving the attachment screws. The bushings engage in corresponding bores of the guide bar. Assembly is facilitated in that the bushings clamp into the bores of the guide bar. In this way, the slide piece is held in the guide bar until the final attachment by means of the attachment screws is made. In order that this clamping force between the bushings and the guide bar is generated, it is advantageous that the spacing between the bushings is greater than the spacing of the bores in the guide bar and by temporarily reducing the spacing between the bushings. The bushings can be guided into the openings of the guide bar. When the legs of the slide piece are released, the bushings clamp in the guide bar so that the displacing unit is held on the guide bar. The displacing unit is conjointly defined by the spiral disc and the slide piece.

The clamping element is preferably configured as a pressure disc which operates to fix the guide bar and a sprocket wheel cover. In this way, the pressure disc simultaneously performs two functions whereby the earlier required fastening of the sprocket wheel cover to the housing utilizing screws becomes superfluous. The sprocket wheel cover has a lug formed on the inner side thereof on which the positioning wheel is journalled and a circular sector of the positioning wheel projects outwardly through a slot of the sprocket wheel cover. In this way, almost the entire adjusting arrangement is covered by the sprocket wheel cover because only the positioning wheel or, more specifically, a portion thereof must be accessible. The slot in the sprocket wheel cover through which the positioning wheel projects simultaneously acts to axially guide the positioning wheel, that is, the width of the slot is so dimensioned that it prevents the positioning wheel from sliding away from the corresponding lug.

During assembly, the plastic material of the sprocket wheel cover is somewhat deformed so that an assembly is possible; however, as soon as the plastic material has again assumed its original position, the positioning wheel is reliably held on the lug.

The sprocket wheel cover has several fixing pins. The cross-sectional shape of the pins is so selected that they can be pressed into corresponding openings of the housing and can engage without play in these openings of the housing. The cross-sectional form of the fixing pins can, for example, be cross-shaped or T-shaped. These fixing pins have the sole task to fix the sprocket wheel cover clearly in its position on the housing. Slipping out is safeguarded against by the pressure disc which has a corresponding surface which comes into contact engagement on the sprocket wheel cover.

The pressure disc is preferably made of plastic having a metal nut pressed therein by means of which the pressure disc can be threadably mounted on a threaded stud bolt fixed in the housing. This combination of the plastic body of the pressure disc and the metal nut affords the advantage that a reduction in weight is obtained because of the plastic and the threaded connection guarantees a maximum of tightness and permanence of shape because of the metal nut. The end face of the metal nut clamps the guide bar and an annular surface of the plastic body of the pressure disc fixes the sprocket wheel cover. This annular surface is provided near the outer periphery of the pressure disc and coacts with a pressure receiving surface of the sprocket wheel cover. The pressure disc is preferably accommodated in an opening of the sprocket wheel cover and the outer side of the pressure disc and the wall of the sprocket wheel cover conjointly define a plane. In this way, a planar housing contour is provided without disturbing projections which could otherwise constitute a hindrance when manipulating the motor-driven chain saw.

The pressure disc is held in the sprocket wheel cover so that it cannot separate therefrom when the pressure disc is detached. This is achieved by providing an undercut in the opening of the sprocket wheel cover. A radial collar of the pressure disc engages behind this undercut. The dimension of the overlap of the undercut and the radial collar is relatively slight so that, when mounting the pressure disc, the pressure disc can easily be pressed into the opening of the sprocket wheel cover thereby permitting assembly.

The pressure disc can be manipulated without an additional tool in that the pressure disc is provided with a hinged bracket which serves as a handle for rotating the pressure disc tight or for releasing the same. This hinged bracket is therefore pivoted out only for acting upon the pressure disc. During normal operation, the hinged bracket is in its pivoted-in position and does not project beyond the actual contour of the sprocket wheel cover and the pressure disc. Resilient means are advantageously provided which resiliently bias the hinged bracket in the direction of its pivoted-in position so that the hinged bracket cannot assume its pivoted-out position by itself which would otherwise constitute a hindrance when manipulating the motor-driven chain saw.

The pressure disc moves between a first position wherein the displacing unit and the guide bar are clamped and a second position wherein the pressure disc is loose. Several revolutions of the pressure disc are necessary between these two positions.

The pressure disc is rotated several times and it can be disadvantageous if the hinged bracket flips back into its closed position each time the operator releases the hinged bracket when making these rotations. To prevent this from happening, it is advantageous to provide a latch nose formed on the hinged bracket which holds the hinged bracket in its pivoted-out position. In order to prevent the pressure disc from becoming loose in the case of vibrations or other influences, it is advantageous to provide a toothed arrangement defining a plurality of projections in the region of the opening and resilient latching means on the pressure disc which engages the tooth configuration. The resilient latching means can be formed as one piece on the hinged bracket. In this way, an unlatching of the toothed configuration and latching means results automatically when the hinged bracket is pivoted to its pivoted-out position.

BRIEF DESCRIPTION OF THE DRAWINGS

The invention will now be described with reference to the drawings wherein:

FIG. 10 is another embodiment of the pressure disc shown in FIG. 3;

FIG. 11 is a perspective view of a hinged bracket;

FIG. 12 is a plan view of another embodiment of the slide piece of FIG. 5;

FIG. 13 is a section view taken along line XIII—XIII of FIG. 12;

DESCRIPTION OF THE PREFERRED EMBODIMENTS OF THE INVENTION

Figure 1:
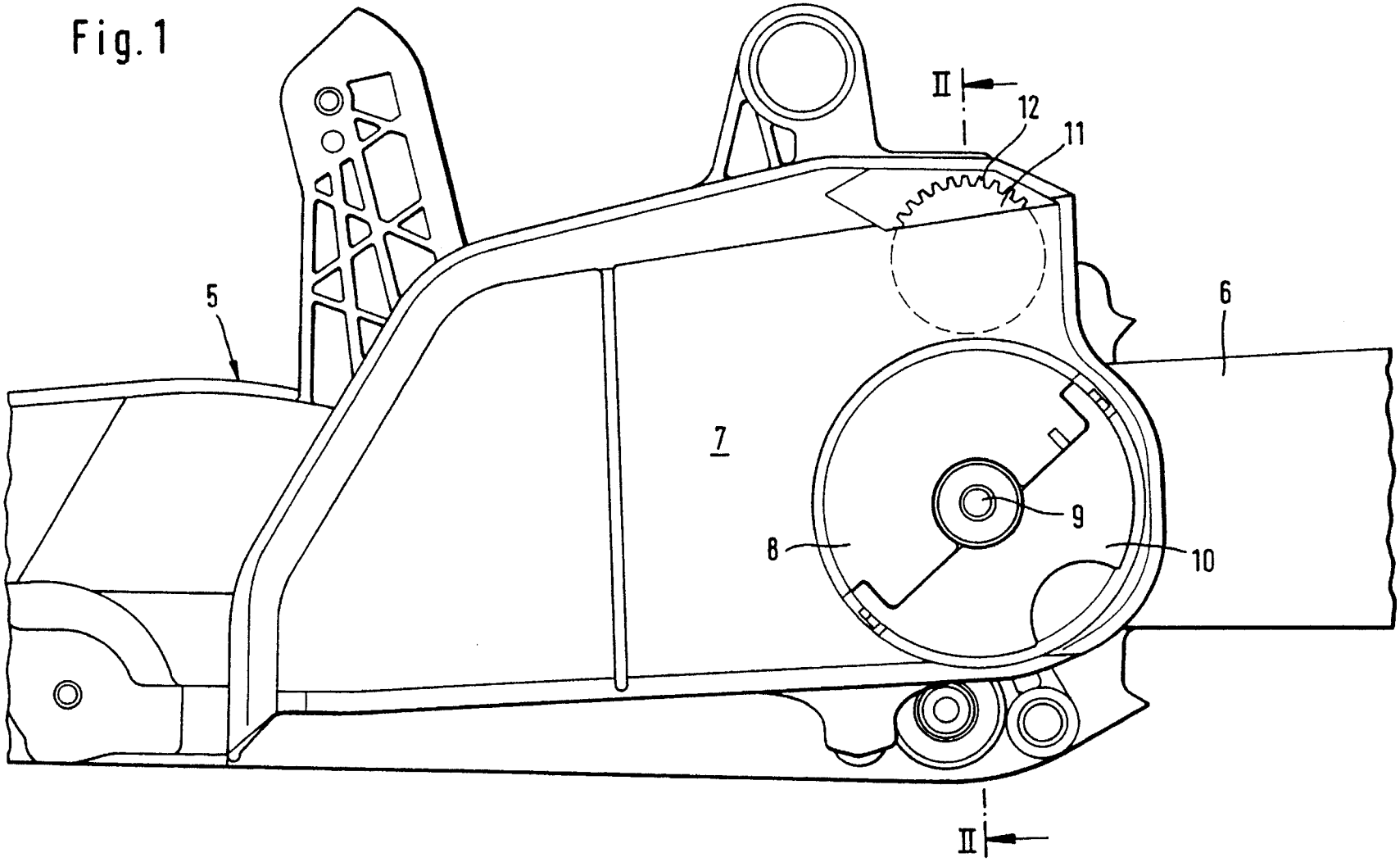
FIG. 1 is a side elevation view of a housing of a motor-driven chain saw equipped with a sprocket wheel cover.

FIG. 1 shows a housing 5 of a motor-driven chain saw having a guide bar 6 and a sprocket wheel cover 7 which is attached to the housing 5 by means of the pressure disc 8. The pressure disc 8 threadably engages threaded bolt 9 and is supported thereon. The pressure disc 8 is provided with a hinged bracket 10 which functions as a handle for tightening or releasing the pressure disc 8. A positioning wheel 11 is disposed in the upper region of the sprocket wheel cover 8. The positioning wheel 11 is journalled inside the sprocket wheel cover 8 and a circular sector thereof projects outwardly from the sprocket wheel cover. The positioning wheel 11 has a uniform sequence of teeth 12 provided on its periphery.

Figure 2:
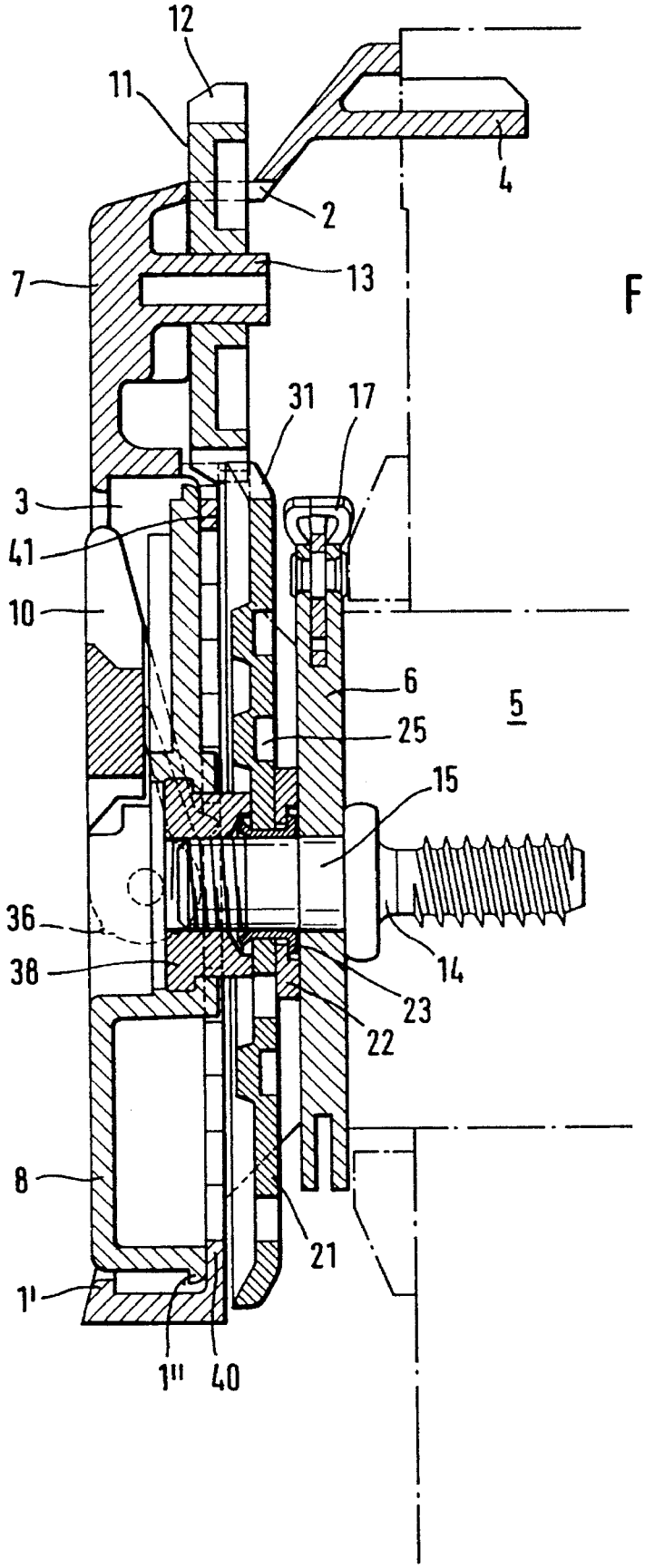
FIG. 2 is a section view taken along line II—II of FIG. 1 and is shown enlarged with respect to FIG. 1.
Figure 3:
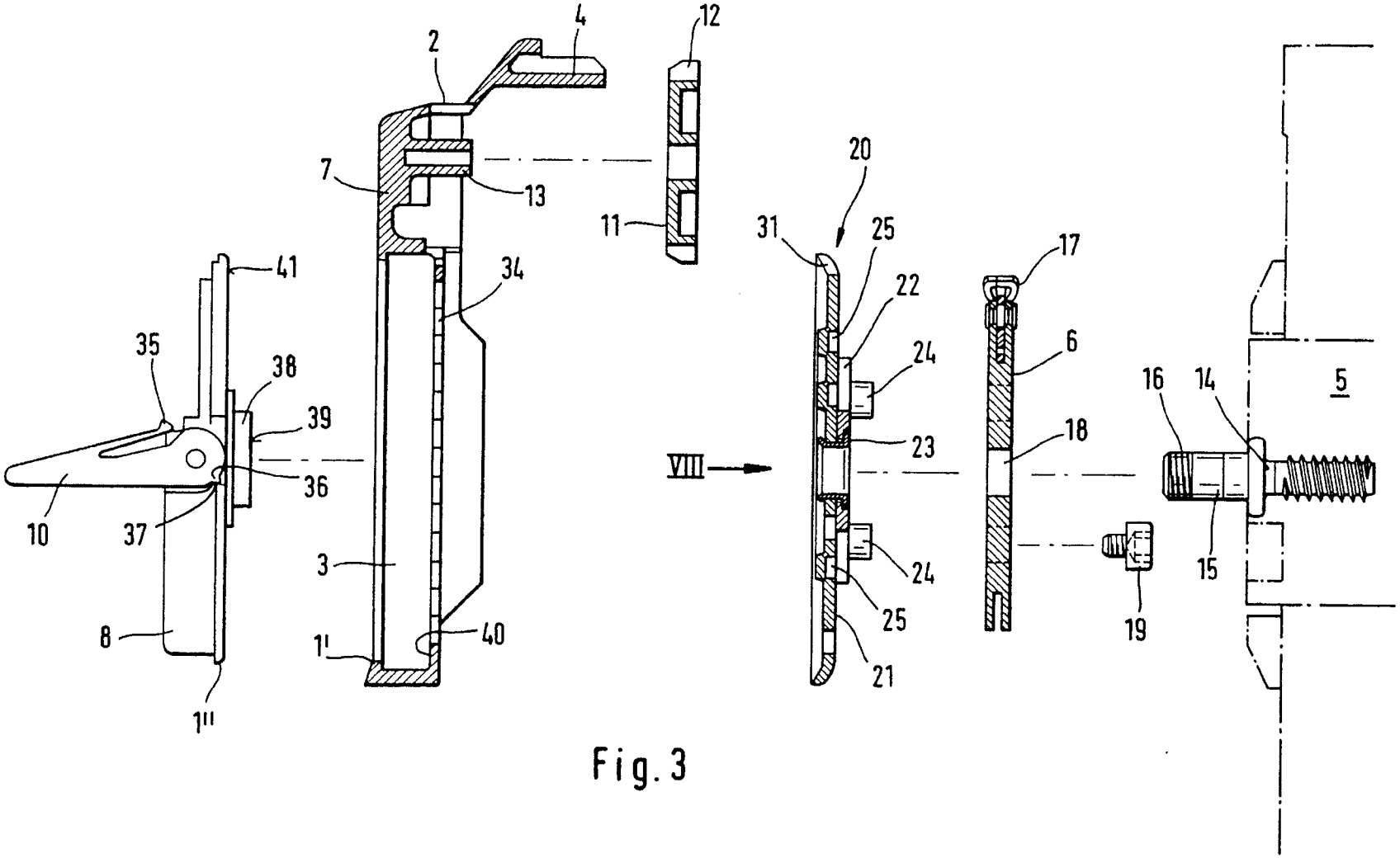
FIG. 3 is an exploded view of the arrangement shown in FIG. 2.

FIG. 2 is a section view taken through the sprocket wheel cover 7 and shows the arrangement for receiving and fixing the guide bar 6 in its mounted state. In contrast, FIG. 3 provides an exploded view in advance of assembly. A stud bolt 14 is held in the housing 5 and passes with its shaft 15 through a slot 18 of the guide bar 6 which functions to guide the saw chain. Furthermore, a displacing unit 20 is supported on the shaft 15 and includes a spiral disc 21 and a slide piece 22. The spiral disc 21 and the slide piece 22 are connected to each other by means of a hollow rivet 23. Shaft 15 passes through the hollow rivet 23 and the slide piece 22 lies with its surface on the guide bar 6. Bushings 24 are formed on the slide piece and engage in corresponding bores in the guide bar 6.

Figure 8:
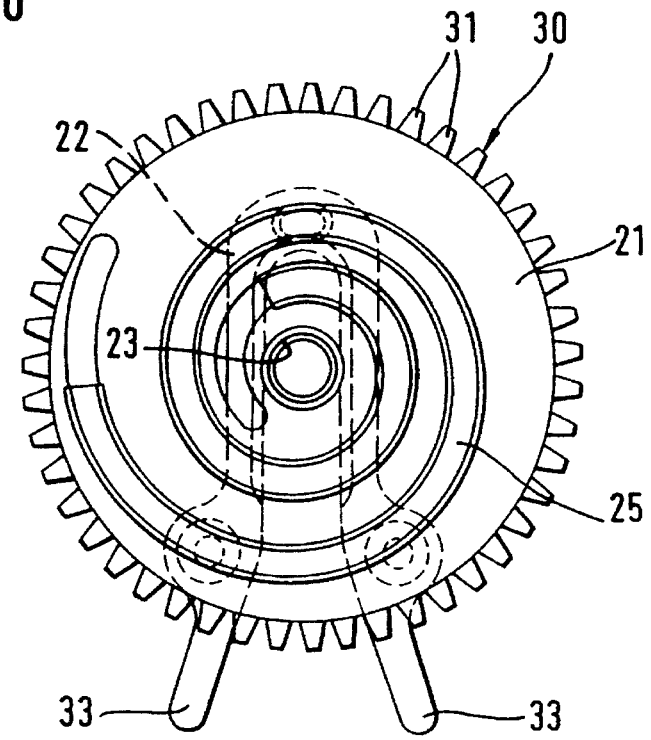
FIG. 8 is a view of the displacing unit as seen in the direction of arrow VIII in FIG. 3.

As shown especially in FIG. 8, the spiral disc 21 has a spirally-shaped slot 25 in which a lug 26 engages. The lug 26 can be seen in FIG. 6 and is formed on the slide piece 22. The lug 26 is displaced in the slot 25 by rotating the spiral disc 21. The slide piece 22 engages with the bushings 24 in the guide bar 6 and is prevented from rotating. In this way, the rotational movement of the spiral disc 21 is converted into an axial movement of the slide piece 22.

Figure 9:
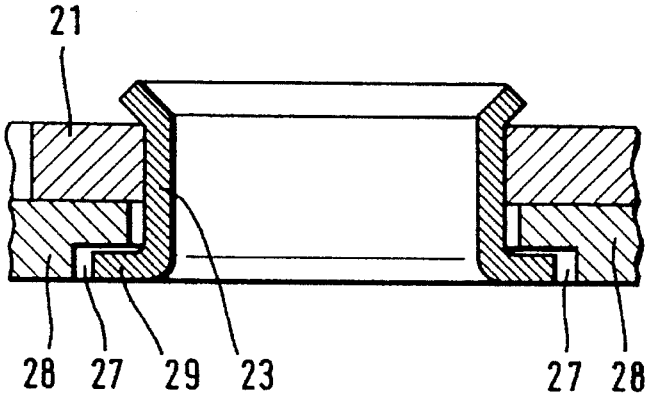
FIG. 9 is an enlarged illustration of the hollow rivet connection of the spiral disc and slide piece.

FIG. 9 shows that the hollow rivet 23 extends through the spiral disc 21 and the slide piece 22 and has a collar 29 arranged at a spacing to the plane of the spiral disc. This collar 29 engages behind the slide piece 22 in the region of its parallel legs 28. The legs 28 have respective longitudinal recesses 27 which function to guide the slide piece 22. The play between the collar 29 and the corresponding surfaces of the recesses 27 is adequate in order to hold the slide piece 22 with respect to the spiral disc 21 so that the spiral disc 21 is free to rotate and the slide disc 22 is free to be displaced in the longitudinal direction.

Figure 5:
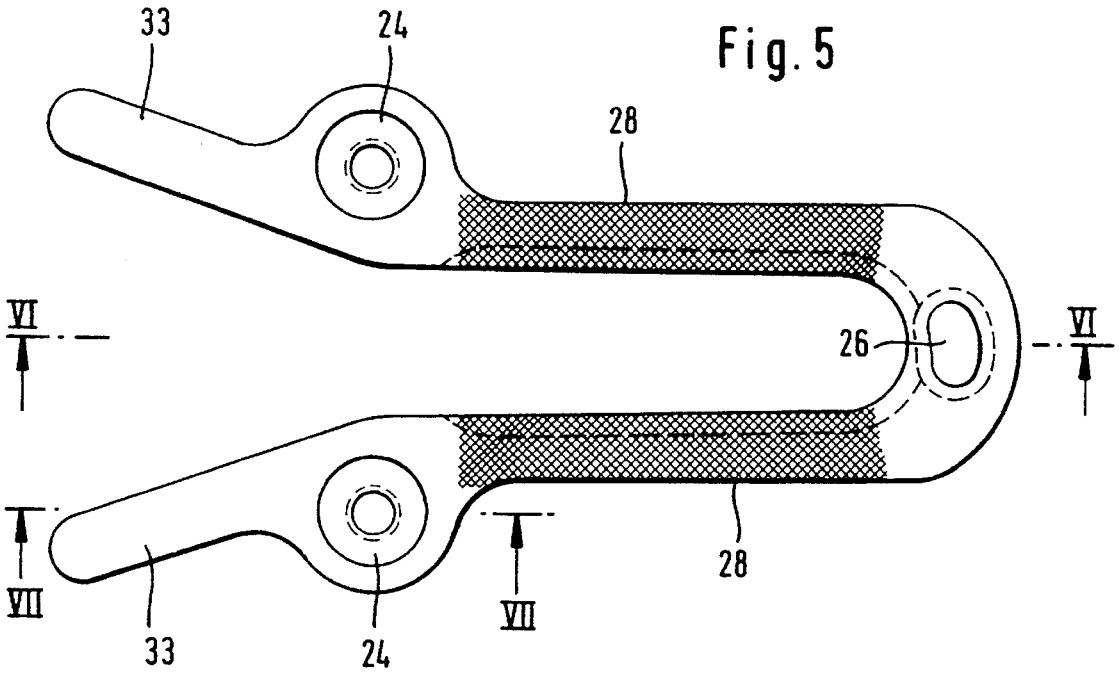
FIG. 5 is a plan view of the slide piece as an individual part.
Figure 6:
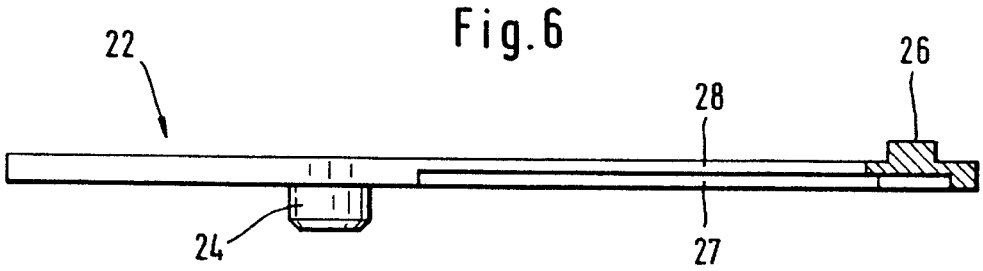
FIG. 6 is a section view taken along line VI—VI of FIG. 5.
Figure 7:
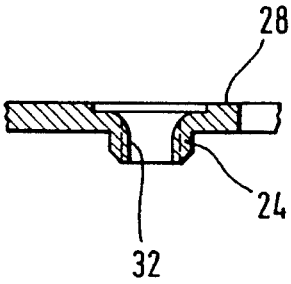
FIG. 7 is a section view taken along line VII—VII of FIG. 5.

The slide piece 22 is essentially U-shaped as shown in FIG. 5. The lug 26 is arranged on the bight portion of the U-shaped slide piece. The bushings 24 are formed on the forward ends of the parallel legs 28 and have an internal thread 32 for receiving respective attachment screws 19. The bushings 24 are shown in section in FIG. 7. The contour of the recesses 27 is shown in FIG. 5 by broken lines. The recesses are formed on the rearward side of the U-shaped slide piece and have a depth as shown in FIG. 6. Arms 33 are formed on the respective free ends of the parallel legs 28. These arms 33 extend outwardly beyond the edge of the spiral disc 21 and function to facilitate assembly in order to bring the bushings 24 into corresponding bores in the guide bar 6. The spacing of the bushings 24 is somewhat greater than the spacings of the bores in the guide bar. The two arms 33 are therefore pressed somewhat toward each other so that the spacing of the bushings 24 corresponds to the spacing of the bores in the guide bar 6. When the arms 33 are released, the bushings 24 then clamp in the guide bar 6 and hold the slide piece 22 securely until final attachment by means of screws 19 is made.

As shown in FIG. 8, the spiral disc 21 has a spur gear 30 formed on its periphery. The spur gear 30 includes forty-seven teeth 31. The teeth 12 of positioning wheel 11 mesh with the teeth 31 of spur gear 30. The positioning wheel 11 is accessible on the outside of the sprocket wheel cover 7 and facilitates the adjustment of the guide bar in the longitudinal direction. The positioning wheel 11 is journalled on a pin 13 formed on the inner side of sprocket wheel cover 7. The pin 13 extends through the positioning wheel 11 below the slot 2.

As shown in FIGS. 2 and 3, the sprocket wheel cover 7 has fixing pins 4 formed thereon which engage without play in openings of the housing 5. In this way, the sprocket wheel cover 7 is precisely positioned on the housing 5 and is held so that it does not vibrate. The fixation against unwanted release of the sprocket wheel cover 7 is provided by means of the pressure disc 8 which is accommodated in an opening 3 of the sprocket wheel cover 7. The opening 3 has an undercut 1' at its end facing outwardly. The undercut 1' is directed radially inwardly and has an inner dimension slightly less than a radial collar 1" formed on the pressure disc 8 so that the pressure disc 8, when released, is held in the opening 3 of the cover 7 in such a manner that it cannot separate therefrom and be lost.

A collar 40 is provided at the end of the opening 3 at which the displacing unit is located. The collar 40 is directed radially inwardly and acts as a support surface for an annular surface 41 of the pressure disc 8 whereby the sprocket wheel cover 7 is fixed. Furthermore, a plurality of projections 34 (FIG. 4) is provided which defines a tooth configuration with which a resiliently supported latch 35 coacts. The latch 35 is formed on the hinged bracket 10. The hinged bracket 10 is configured as a handle and furthermore has a latch nose 36 by means of which the hinged bracket 10 is held in its pivoted-out position by coacting with a projection 37 on the pressure disc 8.

A second embodiment of the hinged bracket is shown in FIG. 10 which is distinguished from the embodiment described above in that a latch nose 45 is formed directly on the outer end 10' of the hinged bracket 10; that is, the latch nose 45 is not attached to a resilient arm. In this way, an arrangement is achieved which provides greater stability wherein the latch means is located at that position of the hinged bracket 10 farthest from the axis of rotation.

A metal nut 38 is pressed into the pressure disc 8 made of plastic. The metal nut 38, on the one hand, threadably engages the threaded section 16 of the stud bolt 14 and, on the other hand, its face 39 is used for clamping the guide bar 6. The metal nut 38 presses the displacing unit 20 against the guide bar 6 and the guide bar, in turn, against the housing 5.

FIG. 11 shows a perspective view of the hinged bracket 10 of FIG. 10 wherein the latch nose 45 is arranged at the outer end 10' of the bracket 10.

Figure 4:
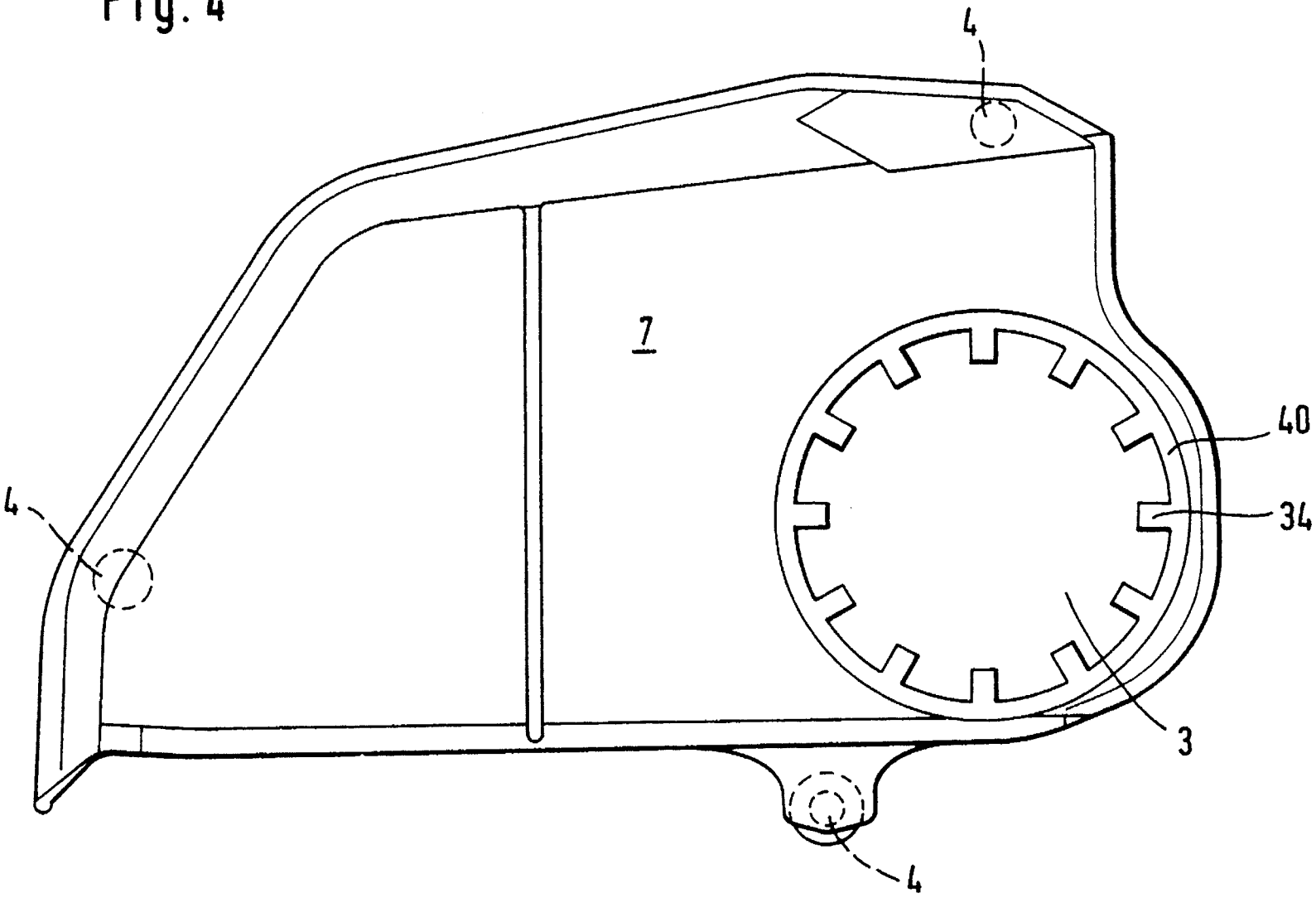
FIG. 4 is a plan view of the sprocket wheel cover as an individual piece.

FIG. 4 shows the sprocket wheel cover 7 as an individual part having fixing pins 4 provided at three locations. The fixing pins 4 are on the rearward side of the cover 7. In the right-hand region, the opening 3 is provided with the radial collar 40 as well as projections 34 which define a toothed arrangement.

As shown in FIG. 5, the surfaces of the parallel legs 28 of the slide piece 22 are knurled or roughened. The degree of roughness amounts to approximately ±0.05 mm. Likewise, an annular surface of the spiral disc with which the slide piece coacts can be configured in this way. The roughness of the bearing surfaces prevents an unwanted displacement from occurring because of influences produced during operation such as vibrations thereby maintaining the adjusted chain tension.

Figure 14:
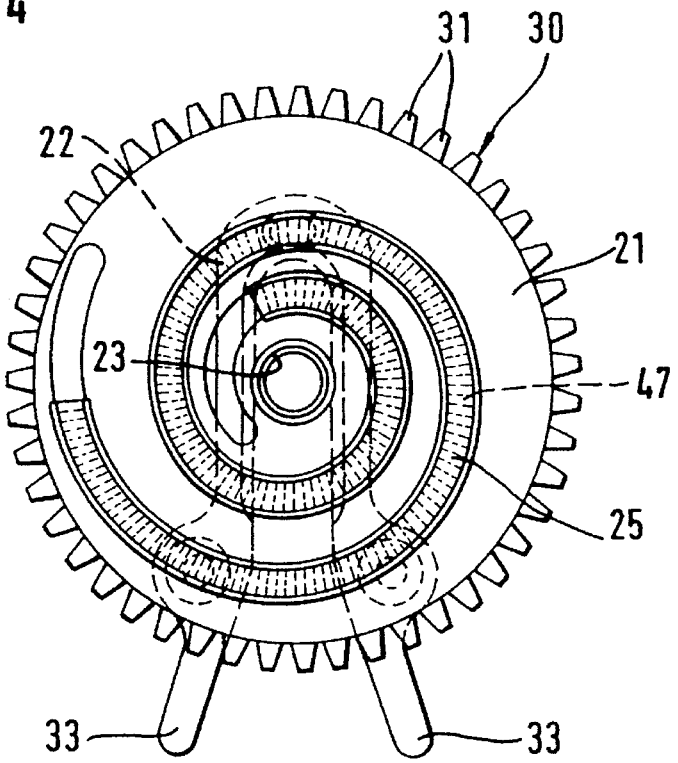
FIG. 14 is a variation of the embodiment of the displacing unit shown in FIG. 8; and, FIG. 15 is a variation of the embodiment of the hollow rivet connection shown in FIG. 9.

FIGS. 12 to 14 show another embodiment wherein a fixation of the slide piece 22 against unwanted displacement is obtained. Here, the projection 26 is provided with several ribs 46 at its outer surface which extend approximately radially referred to a center point of rotation of the slide piece 22 with respect to the spiral disc 21. The several ribs 46 coact with corresponding ribs 47 in the spiral slot 25. The ribs 46 and 47 conjointly define a meshed tooth-like interlock and are preferably configured to have an elevation of approximately 0.5 mm. In this way, the components 21 and 22 mutually engage whereby an optimal safeguard with respect to position is obtained.

Figure 15:
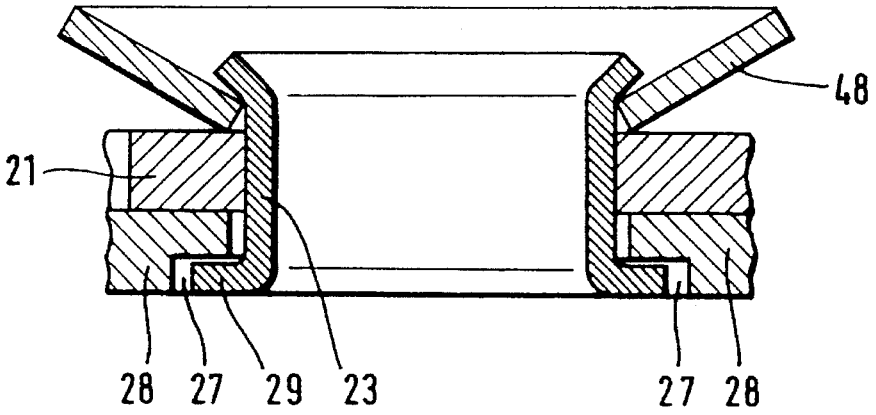

In FIG. 15, an arrangement is shown wherein the hollow rivet 23 engages the inner edge of a plate spring 48 at the end 23' of the rivet which is at the spiral disc. This plate spring 48 ensures that the force-distance characteristic becomes more uniform when the arrangement is clamped. In this way, an adequate pretension force is maintained even when the pressure disc 8 rotates by the angle of a tooth division of the tooth configuration on the sprocket wheel cover.

It is understood that the foregoing description is that of the preferred embodiments of the invention and that various changes and modifications may be made thereto without departing from the spirit and scope of the invention as defined in the appended claims.

What is claimed is:

1. An arrangement for tensioning the saw chain of a motor-driven chain saw having a motor housing and a guide bar for guiding the saw chain, the guide bar defining a longitudinal axis and having two flat sides, one of the flat sides facing toward the housing and the other one of the flat sides facing away from the housing, the arrangement comprising:

said guide bar having an elongated opening formed therein so as to extend in the direction of said axis;

a stud bolt fixedly attached to said housing and extending transversely to said guide bar and through said elongated opening;

a clamping member mounted on said stud bolt which can be tightened to clamp the guide bar on said housing and which can be released to permit the guide bar to be moved along said axis;

a slide piece fixedly attached to said guide bar and having a lug projecting from said slide piece in a direction transverse to said longitudinal axis;

a rotatable disc rotatably mounted on said stud bolt;

holding means for inseparably holding said slide piece on said rotatable disc so as to permit said rotatable disc to rotate relative to said slide piece and so as to permit said slide piece to move in the direction of said axis relative to said rotatable disc;

said rotatable disc having an approximately spiral guide slot formed therein for receiving said lug so that a rotational movement of said rotatable disc is translated via said slide piece into a linear movement of said guide bar thereby adjusting the tension in said chain saw; and, said spiral slot being formed in said disc so as to extend spirally over a rotational angle of at least 270°.

2. The arrangement of claim 1, said rotatable disc having a side surface defining a disc plane and said rotatable disc having a central opening formed therein; said holding means including a hollow rivet mounted in said opening and defining a pass-through opening for receiving said stud bolt therein; and, said hollow rivet having a collar formed thereon disposed at a spacing from said disc plane; and, said slide piece being mounted in said spacing so as to be movable relative to said rotatable disc.

3. The arrangement of claim 2, said slide piece having a side surface in contact engagement with said side surface of said rotatable disc; said side surface of said rotatable disc having an annular surface region surrounding said central opening; and, said annular surface region and said side surface of said slide piece each being roughened.

4. The arrangement of claim 3, the roughened annular surface region and said side surface of said slide piece each being toughened to define a knurling of ±0.05 mm.

5. The arrangement of claim 1, said rotatable disc being made of steel and said spiral guide slot being formed therein.

6. The arrangement of claim 1, said spiral guide slot extending over a rotational angle of approximately 790°.

7. The arrangement of claim 6, said lug and said spiral guide slot conjointly defining a contact interface; and, said spiral guide slot being formed as a logarithmic spiral so that a force developed at said contact interface always acts in the direction of said longitudinal axis and generates a torque having the same magnitude at each location along said spiral guide slot.

8. The arrangement of claim 1, said rotatable disc having a periphery and a spur gear formed on said periphery; and, a positioning wheel rotatably mounted on said chain saw and having teeth formed thereon meshing with said spur gear.

9. The arrangement of claim 8, the teeth of said spur gear being cropped at an angle of approximately 30°.

10. The arrangement of claim 1, said slide piece being an essentially U-shaped body having first and second legs; and, said legs having respective free ends and respective threaded bores formed therein near said free ends.

11. The arrangement of claim 10, said guide bar having two bores formed therein at a first spacing from each other; said legs having two deep drawn bushings, respectively, formed thereon at a second spacing from each other; said bushings engaging respective ones of said bores in said guide bar; said threaded bores being formed in said bushings, respectively; and, said second spacing being greater than said first spacing.

12. The arrangement of claim 8, said chain saw including a sprocket wheel for driving the saw chain and a sprocket wheel cover mounted on said motor housing; and, a pressure disc for fixing said cover and said guide bar on said motor housing.

13. The arrangement of claim 12, said sprocket wheel cover having a lug formed thereon for rotatably journalling said positioning wheel; said cover having a slot formed therein through which a circular sector of said positioning wheel projects outwardly to facilitate access thereto by an operator of the chain saw.

14. The arrangement of claim 12, said cover having fixing pins formed thereon; and, said motor housing having mounting openings formed therein corresponding to respective ones of said fixing pins for holding said fixing pins without play therein.

15. The arrangement of claim 12, said stud bolt having a threaded free end; said pressure disc being made of plastic and having a metal nut pressed thereinto for threadably engaging said threaded free end of said stud bolt thereby mounting said pressure disc on said stud bolt.

16. The arrangement of claim 15, said metal nut having an end face for clamping said guide bar; said pressure disc having a peripheral edge and an annular surface near said peripheral edge for fixing said sprocket wheel cover; and, said sprocket wheel cover having a pressure receiving surface on which said annular surface of said pressure disc acts.

17. The arrangement of claim 16, said sprocket wheel cover having an opening formed therein for receiving said pressure disc; and, said sprocket wheel cover and said pressure disc having respective outer wall surfaces conjointly defining a common plane.

18. The arrangement of claim 17, said sprocket wheel cover having an outer wall defining said outer wall surface and said opening thereof; said opening being delimited by a peripheral edge formed in said sprocket wheel cover; said cover having an undercut formed along said edge and facing away from said outer wall surface of said cover; and, said pressure disc having a radial collar formed thereon for engaging said undercut when said pressure disc is disconnected from said stud bolt and loose in said opening of said cover.

19. The arrangement of claim 18, said pressure disc having a hinged bracket pivotally movable between a pivoted-in position and a pivoted-out position wherein said hinged bracket acts as a handle for an operator of the chain saw to loosen or clamp said guide bar by rotating said pressure disc.

20. The arrangement of claim 19, said pressure disc including: resilient biasing means for resiliently biasing said hinged bracket into said pivoted-in position; and, latching means formed on said hinged bracket for holding said hinged bracket in said pivoted-out position.

21. The arrangement of claim 17, said cover having a plurality of tooth-shaped projections formed thereon one next to the other in the region of said opening thereof; and, latching means formed on said pressure disc for engaging said tooth-shaped projections.

22. The arrangement of claim 2, said side surface of said rotatable disc being a first side surface; said rotatable disc having a second side surface facing away from said slide piece; said hollow rivet having a flange-like collar overlapping a portion of said second side surface; a plate spring having an aperture for receiving said hollow rivet therein; and, said plate spring being disposed between said second side surface and said flange-like collar thereby holding said plate spring with said flange-like collar.

23. The arrangement of claim 2, said spiral slot having a first set of ribs formed therein and said lug having a second set of ribs formed thereon so as to mesh with said first set of ribs.

* * * * *

UNITED STATES PATENT AND TRADEMARK OFFICE

CERTIFICATE OF CORRECTION

PATENT NO. : 5,522,143

DATED : June 4, 1996

INVENTOR(S) : Harald Schliemann, Werner Geyer, Helmutt Zimmermann, Rudolf Krebs and Hans Nickel

It is certified that error appears in the above-identified patent and that said Letters Patent is hereby corrected as shown below:

In column 8, line 20, delete "toughened" and substitute -- roughened -- therefor.

Signed and Sealed this

Seventeenth Day of September, 1996

*Attest:*

*Attesting Officer*

Bruce Lehman

BRUCE LEHMAN

*Commissioner of Patents and Trademarks*